US010446078B2

(12) United States Patent
Tamura

(10) Patent No.: US 10,446,078 B2
(45) Date of Patent: Oct. 15, 2019

(54) DISPLAY DEVICE AND ELECTRONIC APPARATUS

(71) Applicant: SEIKO EPSON CORPORATION, Tokyo (JP)

(72) Inventor: Tsuyoshi Tamura, Hara-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 49 days.

(21) Appl. No.: 15/612,496

(22) Filed: Jun. 2, 2017

(65) Prior Publication Data

US 2017/0372658 A1 Dec. 28, 2017

(30) Foreign Application Priority Data

Jun. 28, 2016 (JP) ..... 2016-127272

(51) Int. Cl.

| | |
|---|---|
| ***G09G 3/3233*** | (2016.01) |
| ***G09G 3/3266*** | (2016.01) |
| ***G09G 3/3283*** | (2016.01) |
| ***G09G 3/3275*** | (2016.01) |

(52) U.S. Cl.

CPC ..... *G09G 3/3233* (2013.01); *G09G 3/3266* (2013.01); *G09G 3/3275* (2013.01); *G09G 3/3283* (2013.01); *G09G 2300/043* (2013.01); *G09G 2300/0852* (2013.01); *G09G 2320/041* (2013.01); *G09G 2330/021* (2013.01)

(58) Field of Classification Search

CPC .. G09G 3/3233; G09G 3/3275; G09G 3/3266; G09G 3/3283; G09G 2320/041; G09G 2330/021; G09G 2300/0852; G09G 2300/043

See application file for complete search history.

(56) References Cited

U.S. PATENT DOCUMENTS

| | | | | |
|---|---|---|---|---|
| 7,760,163 | B2 * | 7/2010 | Jo | G09G 3/3283 345/212 |
| 2003/0030602 | A1 * | 2/2003 | Kasai | G09G 3/325 345/76 |
| 2004/0090434 | A1 * | 5/2004 | Miyazawa | G09G 3/3241 345/204 |
| 2005/0007318 | A1 * | 1/2005 | Kasai | G09G 3/325 345/76 |
| 2005/0052448 | A1 * | 3/2005 | Hayafuji | G09G 3/2014 345/212 |
| 2005/0057459 | A1 * | 3/2005 | Miyazawa | G09G 3/3233 345/76 |
| 2005/0099412 | A1 * | 5/2005 | Kasai | G09G 3/325 345/204 |

(Continued)

FOREIGN PATENT DOCUMENTS

| | | |
|---|---|---|
| JP | 2000-172217 A | 6/2000 |
| JP | 2005-301177 A | 10/2005 |

(Continued)

*Primary Examiner* — Jose R Soto Lopez
(74) *Attorney, Agent, or Firm* — Oliff PLC

(57) ABSTRACT

A display device includes a pixel circuit, a drive circuit that drives a data line connected to the pixel circuit, and a capacitor that is provided between an output node of the drive circuit and the data line. The drive circuit outputs a constant current to the output node during a driving period of which a length is set according to display data.

20 Claims, 12 Drawing Sheets

(56) References Cited

U.S. PATENT DOCUMENTS

2005/0116902 A1* 6/2005 Miyzawa ..... G09G 3/325 345/76
2005/0140596 A1* 6/2005 Lee ..... G09G 3/3233 345/76
2007/0063935 A1* 3/2007 Yoshida ..... G09G 3/325 345/76
2007/0085785 A1* 4/2007 Ozaki ..... G09G 3/2025 345/77
2008/0180463 A1* 7/2008 Ogura ..... G09G 3/325 345/690
2009/0135165 A1* 5/2009 Fukuzako ..... G09G 3/3283 345/204
2011/0084992 A1* 4/2011 Ishizuka ..... G09G 3/3233 345/690
2011/0141084 A1* 6/2011 Kishi ..... G09G 3/2003 345/211
2011/0279437 A1* 11/2011 Komiya ..... G09G 3/3233 345/212
2013/0120338 A1* 5/2013 Kubota ..... G06F 3/038 345/211
2013/0207564 A1* 8/2013 Ota ..... H05B 37/02 315/224
2013/0215158 A1* 8/2013 Fujita ..... G09G 3/3233 345/690
2015/0123961 A1* 5/2015 Park ..... G09G 3/3614 345/212
2016/0042681 A1 2/2016 Tamura et al.
2016/0217759 A1* 7/2016 Morita ..... G09G 3/20
2016/0308513 A1* 10/2016 Park ..... G11C 19/28
2016/0351124 A1* 12/2016 Kim ..... G09G 3/3241
2016/0372050 A1* 12/2016 Kwon ..... G09G 3/3283
2017/0061853 A1* 3/2017 Yang ..... G02F 1/1362
2017/0116919 A1* 4/2017 Ma ..... G02F 1/136213
2017/0249897 A1* 8/2017 Wang ..... G09G 3/3233
2018/0166009 A1* 6/2018 Sun ..... G09G 3/32

FOREIGN PATENT DOCUMENTS

JP 2006-227151 A 8/2006
JP 2007-121925 A 5/2007
JP 2009-237004 A 10/2009
JP 2014-186125 A 10/2014

* cited by examiner

DISPLAY DEVICE AND ELECTRONIC APPARATUS

BACKGROUND

1. Technical Field

The present invention relates to a display device and an electronic apparatus.

2. Related Art

In a display device in which pixels are configured with self-luminous elements such as organic EL or liquid crystal cells, generally, a gradation voltage generation circuit (a gamma circuit) generates a gradation voltage and a D/A conversion circuit or an amplifier circuit drives data lines based on the gradation voltage. For example, in JP-A-2014-186125, a display device is described, in which an amplifier circuit drives data lines via a capacitor.

In the display device described above, it is desirable that the power consumption be low. However, in a case of using the gradation voltage generation circuit, the D/A conversion circuit, or the amplifier circuit, it is difficult to reduce the power consumption in those circuits. For example, since the amplifier circuit needs a bias current, the current is normally flowing in the circuit and this normally flowing current makes it difficult to reduce the power consumption.

SUMMARY

An advantage of some aspects of the invention is that a display device and an electronic apparatus with low power consumption can be provided using a drive method in which the normally flowing current is suppressed.

According to an aspect of the invention, a display device includes a plurality of pixel circuits, a drive circuit that drives a plurality of data lines connected to the plurality of pixel circuits, and a plurality of capacitors each provided between corresponding output node of a plurality of output nodes of the drive circuit and corresponding data line of the plurality of data lines. The drive circuit outputs a constant current to each of the output nodes during a driving period of which a length is set according to display data.

According to the aspect of the invention, a constant current is output to the output node during the driving period of which the length is set according to the display data. Therefore, the voltage at the data line becomes a data voltage corresponding to the display data by the capacitor provided between the output node and the data line. As described above, in the aspect of the invention, since it is sufficient that the constant current flows during the driving period, an amplifier circuit is not necessary, and thus, it is possible to achieve the low power consumption using a drive method in which the normally flowing current is suppressed.

In addition, in the aspect of the invention, the drive circuit may include a plurality of current generation circuits for causing the constant current to flow through the plurality of output nodes, and each current generation circuit of the plurality of current generation circuits may include a drive transistor for causing the constant current to flow and a compensation circuit that compensates a variation of the threshold voltage of the drive transistor.

According to the aspect described above, since the variation of the threshold voltage of the drive transistor is compensated by the compensation circuit, the variation of the constant current output from the drive transistor is compensated. In this way, the compensation can be performed such that the time change rate of the voltage at the data line during the drive period becomes same at each data line.

In the aspect of the invention, the compensation circuit may include a first transistor that is, provided between a gate and a drain of the drive transistor and a first capacitor provided between the gate of the drive transistor and a node of a reference voltage.

When the first transistor is in an ON state, the drive transistor is in a diode connection state, and thus, the gate-source voltage of the drive transistor is close to the threshold voltage of the drive transistor. Then, the capacitor holds the gate voltage of the drive transistor In this way, the threshold voltage of the drive transistor can be compensated.

In the aspect of the invention, each of the current generation circuits may include a second capacitor that is provided between the gate of the drive transistor and a node of a variable voltage, and a gate voltage of the drive transistor set by the compensation circuit may be variably controlled by the variable voltage.

When the variable voltage is changed, the gate voltage of the drive transistor can be changed due to the coupling by the second capacitor as much as the given voltage corresponding to the change of the variable voltage. At this time, the drain current of the drive transistor is a drain current when the gate voltage is changed as much as the given voltage with the threshold voltage as a reference. Therefore, it is possible to obtain the constant current in which the variation of the threshold voltage is compensated.

In the aspect of the invention, each of the current generation circuits may include an initial voltage setting circuit that sets an initial voltage at the gate of the drive transistor.

When the gate voltage of the drive transistor is set to be the initial voltage, the drive transistor is in a state of causing the drain current to flow. Then, in a case where the first transistor is in an ON state, the drain current flows in the drive transistor which is in the diode connection state. In this way, the gate-source voltage of the drive transistor can converge close to the threshold voltage.

In the aspect of the invention, each of the current generation circuits may include a second transistor that is provided between the drive transistor and an output node of the current generation circuit, and is in an ON state during the driving period.

Since the second transistor is in an ON state during the driving period as described above, the drain current of the drive transistor is output to the output node. In this way, the constant current from the drive transistor can be output to the output node during the driving period.

In the aspect of the invention, the period during which the second transistor is in the ON state may be set according to the display data.

A described above, since the period during which the second transistor is in the ON state is set according to the display data, the second transistor can output the constant current to the output node from the drive transistor during the driving period of which the length is set according to the display data.

In the aspect of the invention, each of the current generation circuits may include a first voltage setting circuit that sets a voltage at the output node thereof to be a first given voltage during a compensation period of the plurality of pixel circuits.

During the compensation period of the pixel circuit, the voltage at the data line is changed, and there is a possibility that the voltage at the output node of the current generation circuit is changed via the capacitor. In this regard, according to the aspect of the invention, it is possible to maintain the voltage at the output node of the current generation circuit as the first given voltage during the compensation period of the pixel circuit.

In the aspect of the invention, each of the current generation circuits may include a second voltage setting circuit that sets a voltage at the output node thereof to be a second given voltage before the start of the driving period.

Since the voltage at the output node of the current generation circuit is set as the second given voltage before the start of the driving period, the voltage at the output node of the current generation circuit is changed to the second given voltage from the first given voltage. In this way, the voltage at the data line is changes via the capacitor, and the changed voltage is set as the initial voltage of the voltage change due to the constant current.

In the aspect of the invention, the gate voltage of the drive transistor during the driving period may be variably controlled based on a result of detection of a temperature from a temperature sensor.

The driving ability of the drive transistor is changed according to the temperature of the display device. Therefore, the constant current during the driving period changes according to the temperature. In this regard, according to the aspect of the invention, since the gate voltage of the drive transistor is controlled to change according to the temperature, it is possible to realize the constant current that does not depend on the temperature.

In the aspect of the invention, a slope of a voltage change at the output node of each current generation circuit during the driving period may be controlled based on the result of detection of the temperature from the temperature sensor.

Since the slope of a voltage change at the output node of each current generation circuits during the driving period controlled based on the result of detection of the temperature from the temperature sensor, it is possible to decrease the temperature dependency of the slope. In this way, it is possible to decrease the change of the gradation due to the change of the temperature.

In the aspect of the invention, each pixel circuit of the plurality of pixel circuits is a pixel circuit configured for organic EL elements.

The pixel circuit configured with the organic EL elements includes a transistor that supplies the current the organic EL elements and the gradation is controlled by the gate voltage of the transistor. According to the aspect of the invention, since the drive circuit outputs the constant current during the driving period, the gate voltage of the transistor can be controlled via the data line.

According to another aspect of the invention, a display device includes a pixel circuit, a drive circuit that drives a data line connected to the pixel circuit, and a capacitor that is provided between an output node of the drive circuit and the data line. The drive circuit outputs a constant current to the output node during a driving period of which a length is set according to display data.

According to still another aspect of the invention, an electronic apparatus includes the display device according to the aspects described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferable embodiments of the invention will be described in detail with reference to drawings. The embodiments described below do not unreasonably limit the content of the invention described in the aspects of the invention, and entire of the configurations described in the embodiment are not always the essentially required configurations of the invention.

1. Configuration Example of a Display Device

A drive circuit in the display device drives a plurality of data lines and it is necessary to output accurate data voltages corresponding to the display data for each data line. For example, if there is a variation (error) in the data voltage in each data line in spite of being the same display data, a display quality deteriorates, such as an appearance of vertical lines that ordinarily should not appear.

As described above, an amplifier circuit is used in the drive circuit in the related art. Since a feedback control can be performed the amplifier circuit, the data voltage having a low variation can be output from each data line without being influenced by a process variation (a threshold voltage of a transistor). For this reason, driving by the amplifier circuit or the like has been adopted in the related art. However, there is a problem of power consumption due to a normally flowing current such as a bias current.

For example, in a small sized apparatus such as a head-mount display, it is desirable to achieve low power consumption because it is easier to reduce the size when the heat generation is low. However, in order to drive pixels within a predetermined time, the amplifier circuit needs a driving ability as much as satisfying such requirement, and thus, there a limit to the reduction of the bias current. Alternatively, recent years, a time for driving one pixel becomes short due to the increase of the number of pixels in the display device. When the time for shortening the drive time becomes short, the amplifier circuit needs a high driving ability, which causes the increase of the power consumption.

On the other hand, it is assumed that the feedback control in the amplifier circuit is not used in order to reduce the power consumption. In this case, the same data voltage for the same display data cannot be output from each data line due to the influence by the process variation, and thus, there is a possibility that the display quality deteriorates.

Figure 1:
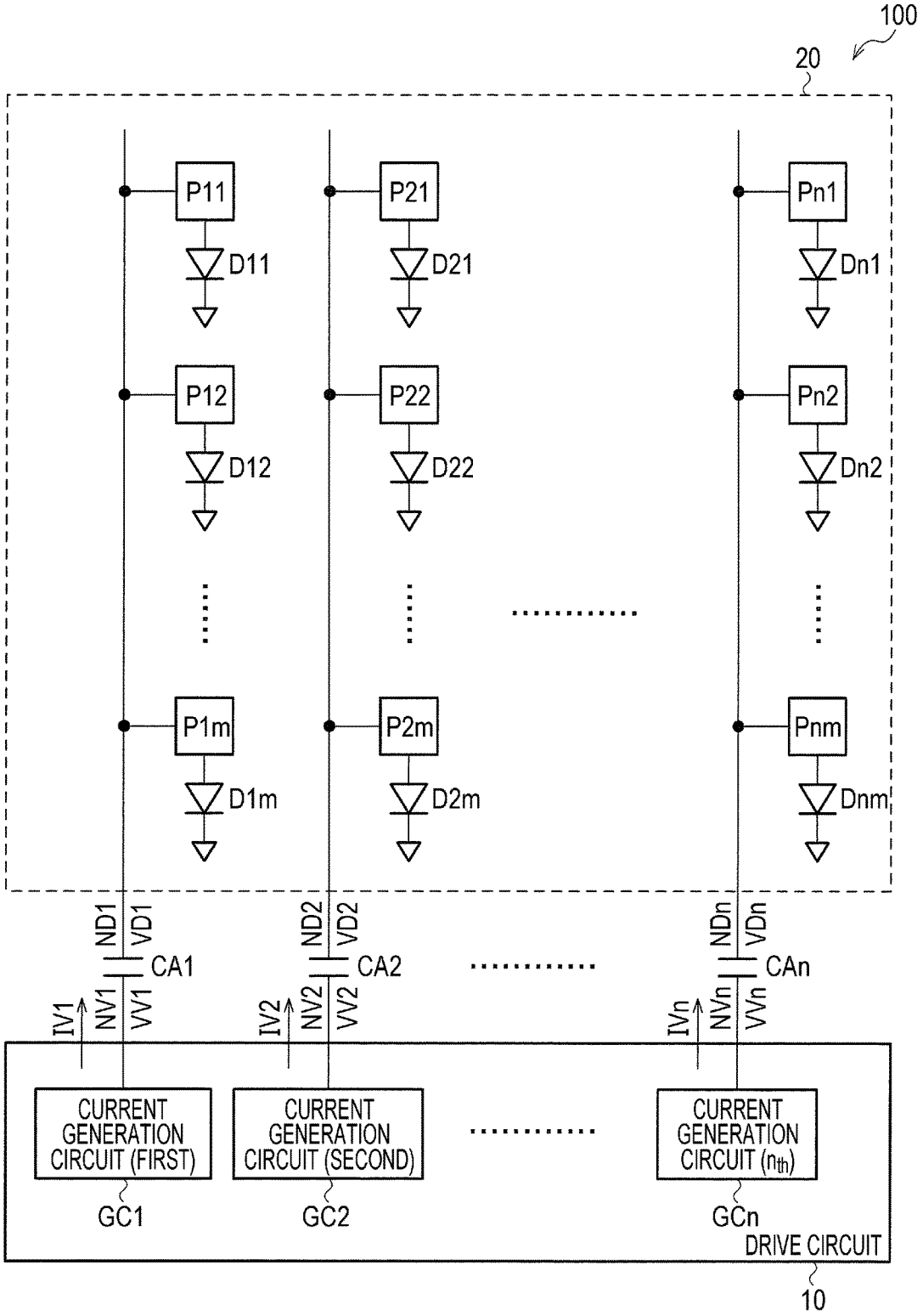
FIG. 1 is a configuration example of a display device in a present embodiment.

FIG. 1 is a configuration example of a display device 100 in the embodiment in which above-described problem can be solved. In the description below, the description will be made with an active matrix type display device in which the pixels are formed with self-luminous elements such as organic EL. However, examples to which the method in the embodiment is applied is not limited to the description below. That is, the method in the embodiment can be applied to any of the display devices as long as the pixel circuit is driven by the voltage (data voltage).

The display device 100 in FIG. 1 includes a drive circuit 10, a pixel array 20, and a plurality of capacitors CA1 to CAn. The pixel array 20 includes a plurality of pixel circuits P11 to Pnm and a plurality of organic EL elements D11 to Dnm (a plurality of pixels). n and m are arbitrary integers equal to or greater than 3 respectively. In a case of the active matrix type display device in which the pixels are formed with self-luminous elements such as organic EL, the configuration elements of the display device 100 are configured on a one chip silicon substrate.

The drive circuit 10 drives a plurality of data lines ND1 to NDn connected to a plurality of pixel circuits P11 to Pnm. Each capacitor of a plurality of capacitors CA1 to CAn is provided between each output node of a plurality of output nodes NV1 to NVn of the drive circuit 10 and each data line of a plurality of data lines ND1 to NDn.

Specifically, the organic EL elements D11 to Dnm (organic EL diodes) are arrayed in a matrix (two dimensions) in the pixel array 20. That is, n number of organic EL elements D1j to Dnj are arrayed along the horizontal scanning direction and m number of organic EL elements Di1 to Dim are arrayed along the vertical scanning direction. i is an integer equal to or greater than 1 and equal to or smaller than n, and j is an integer equal to or greater than 1 and equal to or smaller than m. The pixel circuit Pij is connected to each organic EL element Dij. m number of pixel circuits Pi1 to Pim arrayed in the vertical scanning direction are connected to one data line NDi. The capacitors CAi is provided between the data line NDi and the output node NVi of the drive circuit 10.

Figure 2:
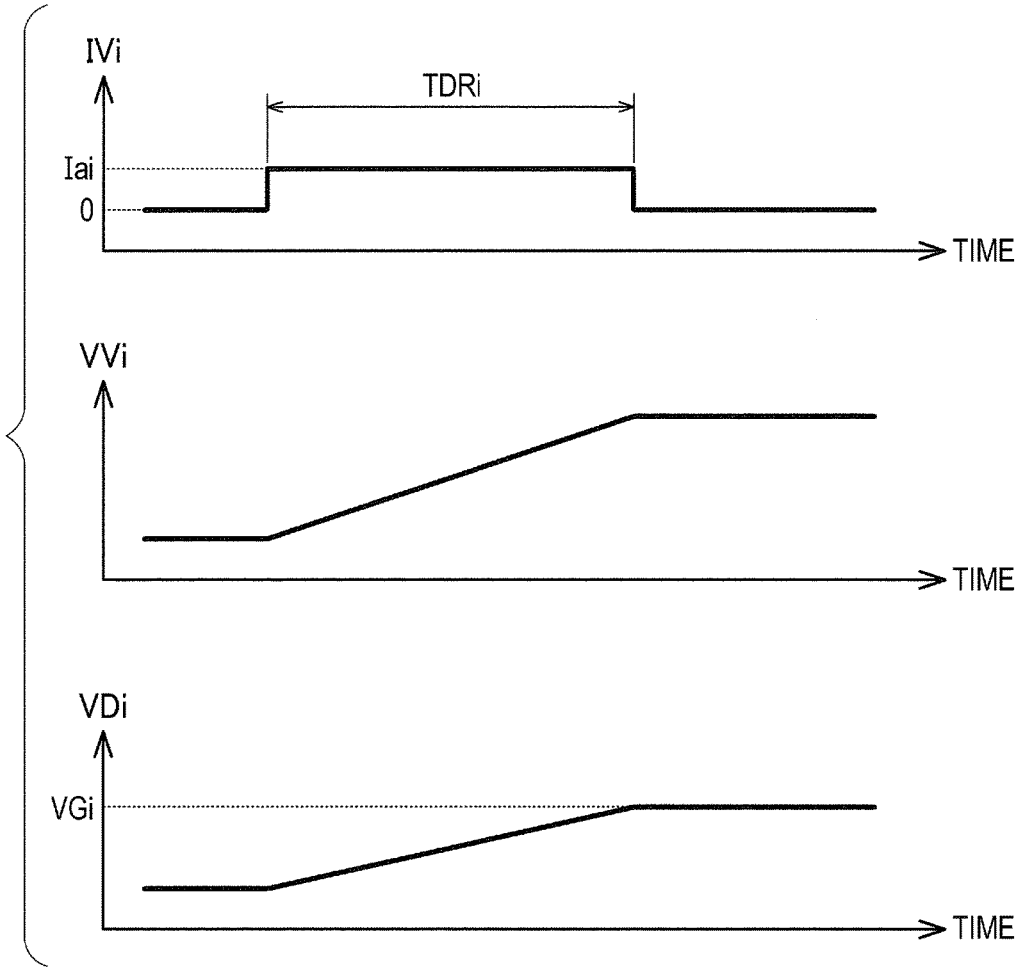
FIG. 2 is a timing chart describing a basic operation of the display device.

FIG. 2 is a timing chart describing a basic operation of the display device 100. A timing chart in a case where the data line NDi is driven is illustrated in FIG. 2. As illustrated in FIG. 2, the drive circuit 10 outputs a constant current Iai to each output node NVi during a driving period TDRi of which the length is set according to the display data. A case where the constant current Iai is greater than 0 is illustrated in FIG. 2, however, the constant current Iai may be smaller than 0.

Specifically, the drive circuit 10 makes the current IVi output to the output node NVi be constant current Iai during the driving period TDRi. The constant current is a current of which the current value does not temporarily change and is constant (including substantially constant). The constant current Iai is supplied to one end of the capacitors CAi, and thus, a voltage VVi at one end(output node NVi) of the capacitors CAi linearly (a constant time change rate) changes during the driving period TDRi. A voltage VDi at the other end(the data line NDi) of the capacitor CAi linearly changes during the driving period TDRi due to coupling by the capacitor CAi. A voltage VGi which is the voltage VDi at the end of the driving period TDRi is the data voltage (gradation voltage) that drives the pixel circuit.

Since the data voltage VGi is proportional to the length of the driving period TDRi, it is possible to control the data voltage VGi by controlling the driving period TDRi according to the display data. For example, the display data and the length of the driving period TDRi may be associated with each other so as to have characteristics similar to the gamma characteristics realized by the gradation voltage generation circuit in which ladder resistors are used in the related art.

According to the embodiment, since the constant current Iai is output from the output node NVi during the driving period TDRi of which the length is set according to the display data, the voltage VDi at the data line NDi becomes the data voltage VGi corresponding to the display data owing to the capacitors CAi provided between the output node NVi and the data line NDi. In this way, it possible to achieve the low power consumption using a drive method in which the normally flowing current is suppressed. That is, in the embodiment, it is sufficient that the constant current Iai flows during the driving period TDRi. Therefore, it becomes unnecessary to provide the amplifier circuit, and thus, the normally flowing current such as the bias current is not necessary. Basically, the power is consumed only by the constant current Iai flowing during the driving period TDRi and the power consumption due to the normally flowing current can be reduced. Therefore, it is possible to realize the extremely low power consumption.

In addition, in the embodiment, as illustrated in FIG. 1, the drive circuit 10 includes a plurality of current generation circuits GC1 to GCn to cause the constant current to flow through the plurality of output nodes NV1 to NVn. As described below in FIG. 3, each current generation circuit GCi includes a drive transistor KDR for causing the constant current Iai to flow and a compensation circuit 11 that compensates the variation of the threshold voltage at the drive transistor KDR.

Specifically, the drive circuit 10 includes a first to $n_{th}$ current generation circuits GC1 to GCn. The current generation circuit GCi generates a current IVi which becomes the constant current Iai during the driving period TDRi and outputs the current IVi to the output node NVi.

In display quality embodiment, the drive transistor KDR is provided in correspondence with each data line NDi. Therefore, if the threshold voltages at the drive transistors KDR provided in correspondence to the different data lines become different from each other, the current values of the constant currents output from each of the drive transistors KDR are different from each other. Then, the time change rate (the slope of the voltage VDi in FIG. 2) of the voltage VDi at the data line NDi becomes different for each data line, and thus, even during the same driving period TDRi, the data voltage VGi to reach becomes different for each data lines. This variation of the data voltage causes the deterioration of the display quality.

In this point, according to the embodiment, the variation of the threshold voltage of the drive transistor KDR is compensated by the circuit 11. Therefore, the compensation is performed such that the time change rate of the voltage VDi becomes same at each data line NDi. In this way, the variation of the data voltage at each data line is compensated, and thus, the display quality can be improved.

Figure 3:
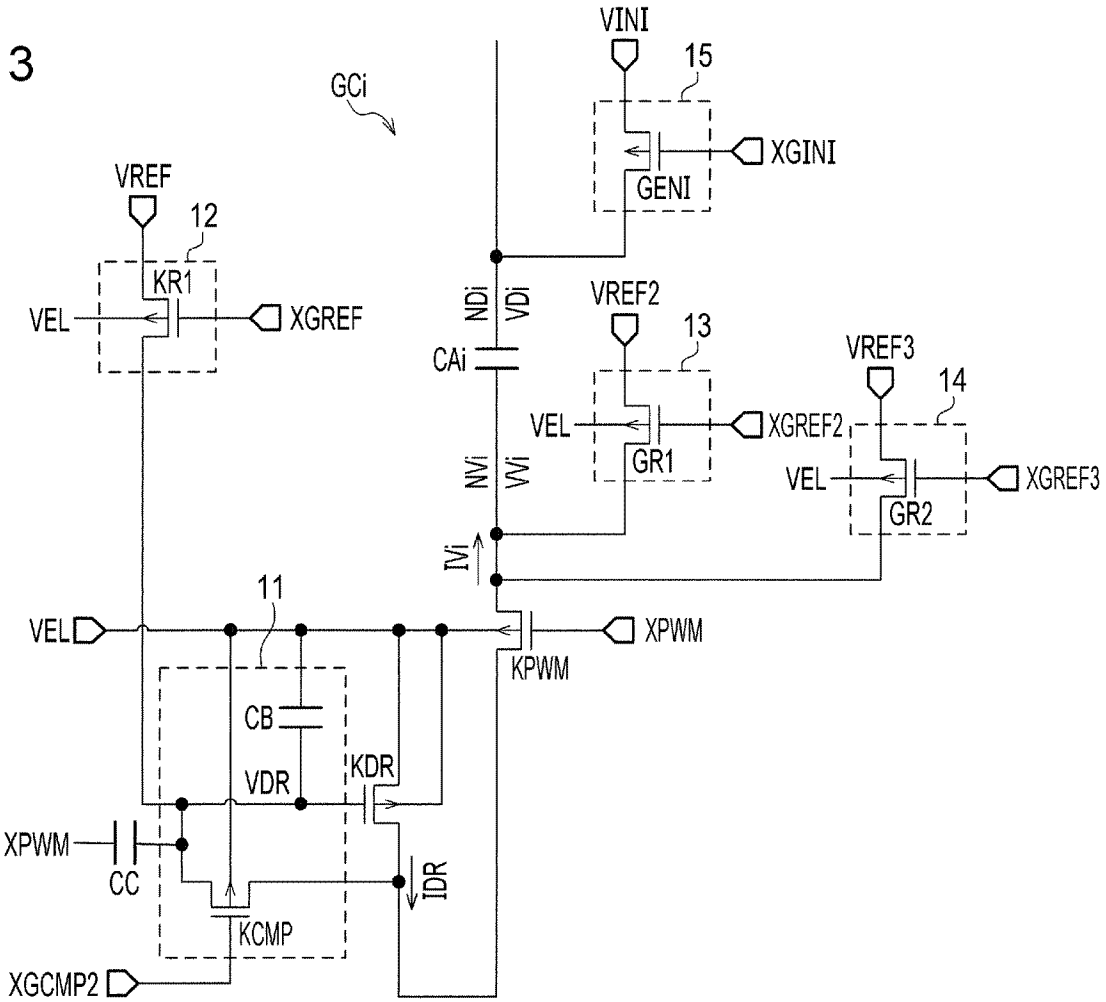
FIG. 3 is a detailed configuration example of a current generation circuit.
Figure 4:
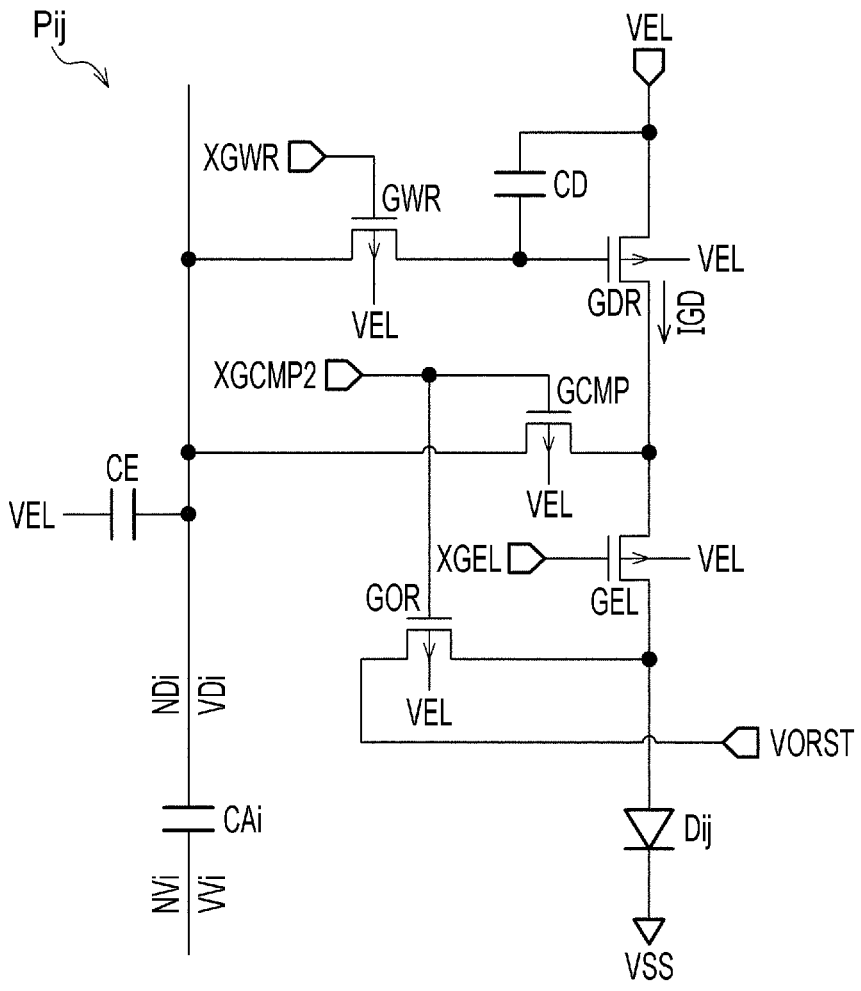
FIG. 4 is a detailed configuration example of a pixel circuit.

2. Detailed Configuration Example of the Current Generation Circuit and the Pixel Circuit FIG. 3 is detailed configuration example of the current generation circuit GCi. FIG. 4 is a detailed configuration example of the pixel circuit Pij. The current generation circuit GCi includes the compensation circuit 11, an initial voltage setting circuit 12, a first voltage setting circuit 13, a second voltage setting circuit 14, a third voltage setting circuit 15, the capacitor CC, the drive transistor KDR, and a transistor KPWM. The pixel circuit Pij includes the capacitor CD and transistors GWR, GDR, GCMP, GEL, and GOR. The outline of the operation will be described below and the details of the operation will be described in FIG. 5 to FIG. 10 below.

As illustrated in FIG. 3, the compensation circuit 11 includes a first transistor KCMP provided between a gate and a drain of the drive transistor KDR, and a first capacitor CB provided between a gate of the drive transistor KDR and a node of a high-potential side power supply voltage VEL (in a broad sense, a reference voltage). The high-potential side power supply voltage VEL is supplied to a source of the drive transistor KDR. The transistor KCMP is controlled to be in ON and OFF state by a signal XGCMP2.

When the transistor KCMP is in an ON state, the drive transistor KDR in a diode connection, and the gate-source voltage of the drive transistor KDR becomes close to the threshold voltage of the drive transistor KDR. Then, the capacitor CB holds the gate voltage VDR of the drive transistor KDR. In this way, the capacitor CB holds the voltage corresponding to the threshold voltage of the drive transistor KDR, and thus, the threshold voltage of the drive transistor KDR can be compensated.

In addition, in the embodiment, a second capacitor CC is provided between the gate of the drive transistor KDR and a node of a variable voltage XPWM. Then, the gate voltage VDR of the drive transistor KDR set by the compensation circuit 11 is controlled by the variable voltage XPWM so as to be variable. For example, the voltage generation circuit 50 in FIG. 11 controls the variable voltage XPWM to be variable and outputs the result.

The gate-source voltage of the drive transistor KDR is close to the threshold voltage by the compensation circuit 11. In this state, when the variable voltage XPWM is changed, the gate voltage of the drive transistor KDR can be changed due to the coupling by the capacitor CC as much as the given voltage. At this time, the variable voltage XPWM is changed in a direction of increasing (making the drive transistor KDR be close to ON state) a drain current IDR of the drive transistor KDR. The drain current IDR of the drive transistor KDR is a drain current when the gate voltage is changed as much as the given voltage with the threshold voltage as a reference. Therefore, it is possible to obtain the constant current in which the variation of the threshold voltage is compensated.

In addition, in the embodiment, the initial voltage setting circuit 12 sets an initial voltage of the gate voltage VDR of the drive transistor KDR. Specifically, the initial voltage setting circuit 12 is a transistor KR1 provided between a node of a reference voltage VREF and the gate of the drive transistor KDR. The transistor KR1 is controlled to be in ON and OFF state by a signal XGREF.

When the transistor KR1 is in an ON state, the gate voltage VDR of the drive transistor KDR is set to be the reference voltage VREF. This reference voltage VREF becomes the initial voltage. The initial voltage is a voltage that makes the drive transistor KDR be in an ON state (makes the drive transistor KDR cause a certain degree of drain current to flow). That is, when the transistor KR1 is in an ON state and the gate voltage VDR is set to be the initial voltage, the drive transistor KDR is in a state of causing the drain current to flow. Then, the after the transistor KR1 is in an ON state, the transistor KCMP of the compensation circuit 11 is in an ON state, the drain current flows in the drive transistor KDR which is in the diode connection state. In this way, the gate-source voltage of the drive transistor KDR can converge close to the threshold voltage.

In addition, in the embodiment, the second transistor KPWM is provided between the drive transistor KDR and the output node NVi of each current generation circuit GCi, and becomes in an ON state during the driving period TDRi. The second transistor KPWM is controlled to be in ON and OFF state by the variable voltage XPWM. As the variable voltage XPWM controlling the second transistor KPWM, the voltage same as the voltage supplied to the second capacitor CC is used, however, the different voltage may be used.

In this way, the second transistor KPWM becomes in an ON state during the driving period TDRi, and thus, the drain current IDR of the drive transistor KDR is output to the output node NVi. As described above, the drain current IDR of the drive transistor KDR is the constant current in which the threshold voltage is compensated. Therefore, it is possible to output the constant current in which the variation is compensated.

In addition, in the embodiment, a duration for the second transistor KPWM to be in an ON state is set according to the display data. Specifically, the voltage level of the variable voltage XPWM input to the gate of the second transistor KPWM becomes a level that makes the second transistor KPWM be in an ON state during the period of which the length is set according to the display data. At a time outside that period, the voltage level of the variable voltage XPWM is a level that makes the second transistor KPWM be in an OFF state.

As described above, the period during which the second transistor KPWM is in an ON state is set according to the display data. Therefore, the second transistor KPWM can output the constant current during the driving period TDRi having the length corresponding to the display data.

In addition, in the embodiment, the first voltage setting circuit 13 sets the voltage at the output node NVi of each current generation circuit GCi to be a first given voltage during a compensation period of a plurality of pixel circuits Pi1 to Pim (the pixel circuits driven by each current generation circuit GCi). Specifically, the first voltage setting circuit 13 is a transistor GR1 provided between the node at which the voltage is reference voltage VREF2 and the output node NVi. The transistor GR1 is controlled to be in ON and OFF state by the signal XGREF2.

As illustrated in FIG. 4, the pixel circuit Pij includes a transistor GDR that causes the current to flow through the organic EL element Dij. In addition, the pixel circuit Pij includes the capacitor CD and the transistors GWR, GCMP, GEL, and GOR. The transistor GWR is provided between the gate of the drive transistor GDR and the data line NDi, and is controlled to be in ON and OFF state by a control signal XGWR. A transistor GCMP is provided between the drain of the drive transistor GDR and the data line NDi, and is controlled to be in ON and OFF state by a control signal XGCMP2. A transistor GEL is provided between the drain of the drive transistor GDR and the organic EL element Dij, and is controlled to be in ON and OFF state by a control signal XGEL. The transistor GDR is provided between the node of the high-potential side power supply voltage VEL and the transistor GEL, and is controlled to be in conductive state or not by the gate-source voltage of the transistor GDR. When the transistor GEL is in an ON state, a current corresponding to the gate-source voltage of the transistor GDR is supplied to the organic EL element Dij. The transistor GOR is provided between the organic EL element Di and a node of a power supply voltage VORST, and is controlled to be in ON and OFF state by the control signal XGCMP2. Here, the transistor GOR and the transistor GCMP are controlled by the control signal XGCMP2 in common, but may be controlled by signals different from each other.

A period during which the variation of the threshold voltage of the transistor GDR is compensated is the compensation period. This compensation operation is performed by the transistor GCMP (a compensation circuit) and the compensation period is a period during which the transistor GCMP is in an ON state. During the compensation period, the transistors GWR and GCMP are in ON state, and the transistor GDR is in a diode connection state thereto. Then, the gate-source voltage of the transistor GDR is close to the threshold voltage of the transistor GDR, and the gate voltage of thereof is held in the capacitor CD. During this compensation period, since the gate and the drain of the transistor GDR are connected to the data line NDi, the voltage VDi of the data line NDi changes together with the changes of gate voltage and the drain voltage of the transistor GDR. When the voltage VDi of the data line NDi changes, the voltage VVi of the output node NVi of the current generation circuit GCS changes due to the coupling by the capacitor CAi.

in the embodiment, the transistor GR1 is in an ON state during this compensation period, and thus, the voltage VVi of the output node NVi is set to be the reference voltage VREF2. This reference voltage VREF2 is the first given voltage. In this way, even though the voltage VDi of the data line NDi changes during the compensation period, it is possible to maintain the voltage VVi at the output node NVi as the first given voltage.

In addition, in the embodiment, the second voltage setting circuit 14 sets the output node NVi of each current generation circuit GCi to be a second given voltage before the start of the driving period TDRi. Specifically, the second voltage setting circuit 14 is a transistor GR2 provided between the node of the reference voltage VREF3 and the output node NVi. The transistor GR2 is controlled to be in ON and OFF state by the signal XGREF3.

The transistor GR2 is in an ON state after the end of the compensation period of the pixel circuit Pij and before the start of the driving period TDRi, and the voltage VVi of the output node NVi is set to be the reference voltage VREF3. This reference voltage VREF3 is the second given voltage. That is, the output node NVi changes to the second given voltage from the first given voltage after the end of the compensation period, and the voltage VDi of the data line NDi changes due to the coupling by the capacitors CAi. This change is a change with the reference as the gate voltage of the transistor GDR of which the variation of the threshold voltage is compensated. In this way, the initial voltage of the data line NDi at the start of the driving period TDRi is determined, and the voltage VDi of the data line NDi can be linearly changed by the constant current Iai from the initial voltage.

In addition, in the embodiment, the third voltage setting circuit 15 sets the initial voltage of the data line NDi. Specifically, the third voltage setting circuit 15 is a transistor GENI provided between a node of a high-potential side power supply voltage VINI (in broad sense, the reference voltage) and the data line NDi. The transistor GENI is controlled to be in ON and OFF state by a signal XGINI.

The transistor GENI is in an ON state before the compensation period of the pixel circuit Pij, and the voltage VDi of the data line NDi is set to be the voltage VINI. This voltage VINI is the initial voltage. Specifically, the transistor GENI is in an ON state during the compensation period of the drive transistor KDR. This compensation period is a period during which the threshold voltage of the drive transistor KDR is compensated by the compensation circuit 11 and a period during which the transistor KCMP is in an ON state.

In addition, in the embodiment, the gate voltage VDR of the drive transistor KDR during the driving period TDRi is controlled based on a result of detecting a temperature by a temperature sensor. Specifically, a voltage at the variable voltage XPWM input via the capacitor CC during the driving period TDRi is changed according to the temperature. The control of this variable voltage is performed, for example, by the voltage generation circuit 50 in FIG. 11 based on the result of detecting the temperature by a temperature sensor 60. The temperature sensor may be provided on the outside of the display device 100.

The driving ability (the drain current flowing at the same gate-source voltage) of the drive transistor KDR is changed according to the temperature of the display device. Therefore, the constant current during the driving period TDRi changes according to the temperature. According to the embodiment, the gate voltage of the drive transistor KDR is controlled to change according to the temperature. Therefore, it is possible to realize the constant current that does not depend on the temperature.

In addition, in the embodiment, the slope of the voltage change at the output node NVi of each current generation circuit GCi during the driving period TDRi is controlled based on the result of detection the temperature from the temperature sensor. Specifically, the slope (that is, the current value of the constant current) is controlled to be constant without depending on the temperature.

Since the driving ability of the drive transistor KDR decreases as the temperature increases, the variable voltage XPWN is changed to the direction of increasing the drain current of the drive transistor KDR as the temperature increases. In this way, the slope of the voltage change by the constant current can be maintained to be constant without depending on the temperature, and thus, it is possible to decrease the change of the gradation (emission brightness) due to the change of the temperature.

The transistors KDR, KCMP, KPWM, KR1, GR1, GR2, and GENI of the current generation circuit GCi are, for example, P-type MOS transistors (first conductivity type transistors). In addition, the transistors GDR, GWR, GCMP, GEL, and GOR in the pixel circuit Pij are, for example, P-type MOS transistors. As described above, it is preferable that the transistor KDR of the current generation circuit GCi be the conductivity type transistors same as the transistor GDR of the pixel circuit Pij. In addition, furthermore, it is preferable that all the transistors configuring the current generation circuit GCi and the pixel circuit Pij be the same conductivity type transistors. The high-potential side power supply voltage VEL is a power supply voltage that is commonly supplied to the current generation circuit GCi and the pixel circuit Pij, but the power supply voltages different from each other may be supplied.

Figure 11:
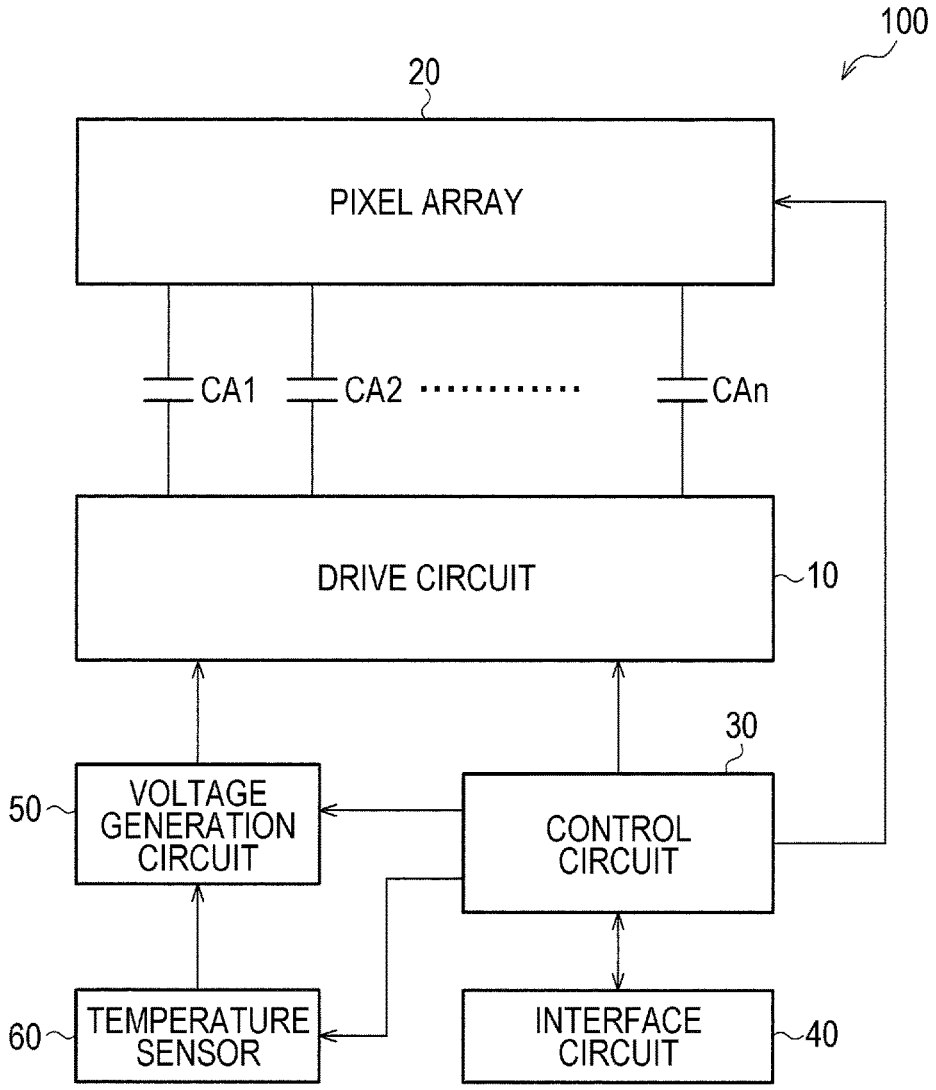
FIG. 11 is a detailed configuration example of the display device in the embodiment.

In addition, the control signals XGCMP2, XGREF, XGREF2, XGREF3, XGINI, XGWR, and XGEL of the transistor of the current generation circuit GCi and the pixel circuit Pij are output by, for example, a control circuit 30 in FIG. 11. The control signals XGWR, XGCMP2, and XGEL may be output by, for example, a (not illustrated) control line drive circuit. In addition, the voltages VEL, VINI, VREF, VREF2, and VREF3 supplied to the current generation circuit GCi and the pixel circuit Pij are output by, for example, a voltage generation circuit 50 in FIG. 11.

3. Operations of the Current Generation Circuit and the Pixel Circuit

FIG. 5 to FIG. 8 are timing charts describing the operations of the current generation circuit GCi and the pixel circuit Pij. In FIG. 5 to FIG. 8, the horizontal axis is the time axis and represents the time with a horizontal scanning period as "one" unit. In the description below, the description will be made with a case where the transistors of the current generation circuit GCi and the pixel circuit Pij are the P type MOS transistors.

Figure 5:
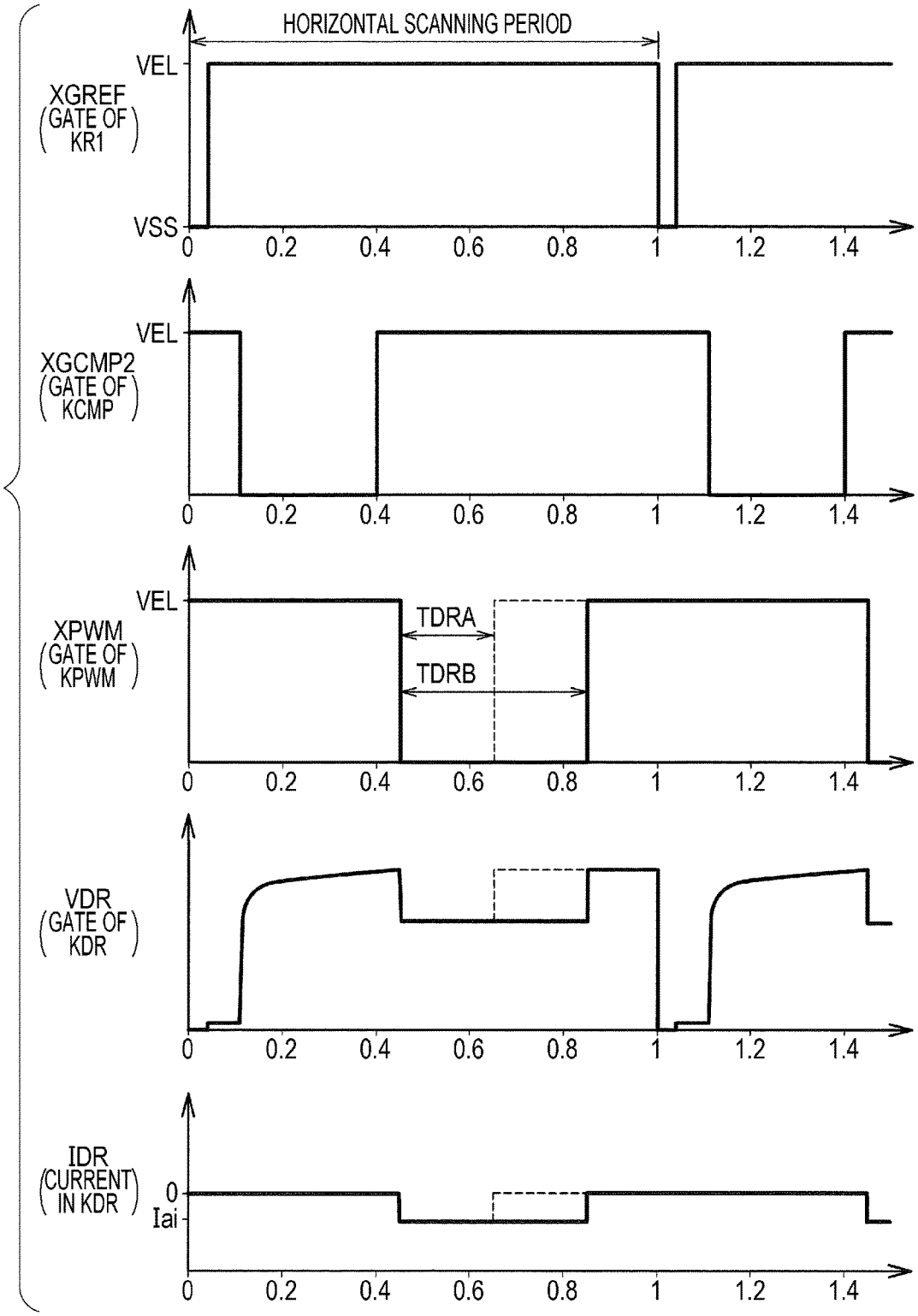
FIG. 5 is a tiring chart describing operations of the current generation circuit and the pixel circuit.

As illustrated in FIG. 5, firstly, the level of the signal XGREF is low (a low-potential side power supply voltage VSS, for example, 0 V) and the transistor KR1 is in an ON state, and the gate voltage VDR of the drive transistor KDR is set to be the voltage VREF.

The level of the signal XGCMP2 becomes low (⅔×VEL) after the transistor KR1 is in an OFF state, and thus, the transistor KCMP is in an ON state. The gate and the drain of the drive transistor KDR are connected to each other and the gate voltage VDR is close to the threshold voltage of the drive transistor KDR, and then, the transistor KCMP is in an ON state, and thus, the eat voltage VDR is held in the capacitor CB.

Next, the level of the variable voltage XPWM changes to be low level (close to ⅔×VEL, variable according to the temperature) from high level (VEL). The gate voltage VDR of the drive transistor KDR decreases due to the coupling by the capacitor CC such that the larger amount of drain current IDR can flow. In this way, the threshold voltage of the drive transistor KDR held in the capacitor CB is offset by the variable voltage XPWM, and thus, it is possible to realize the constant current Iai in which the variation of the threshold voltage is compensated.

Figure 7:
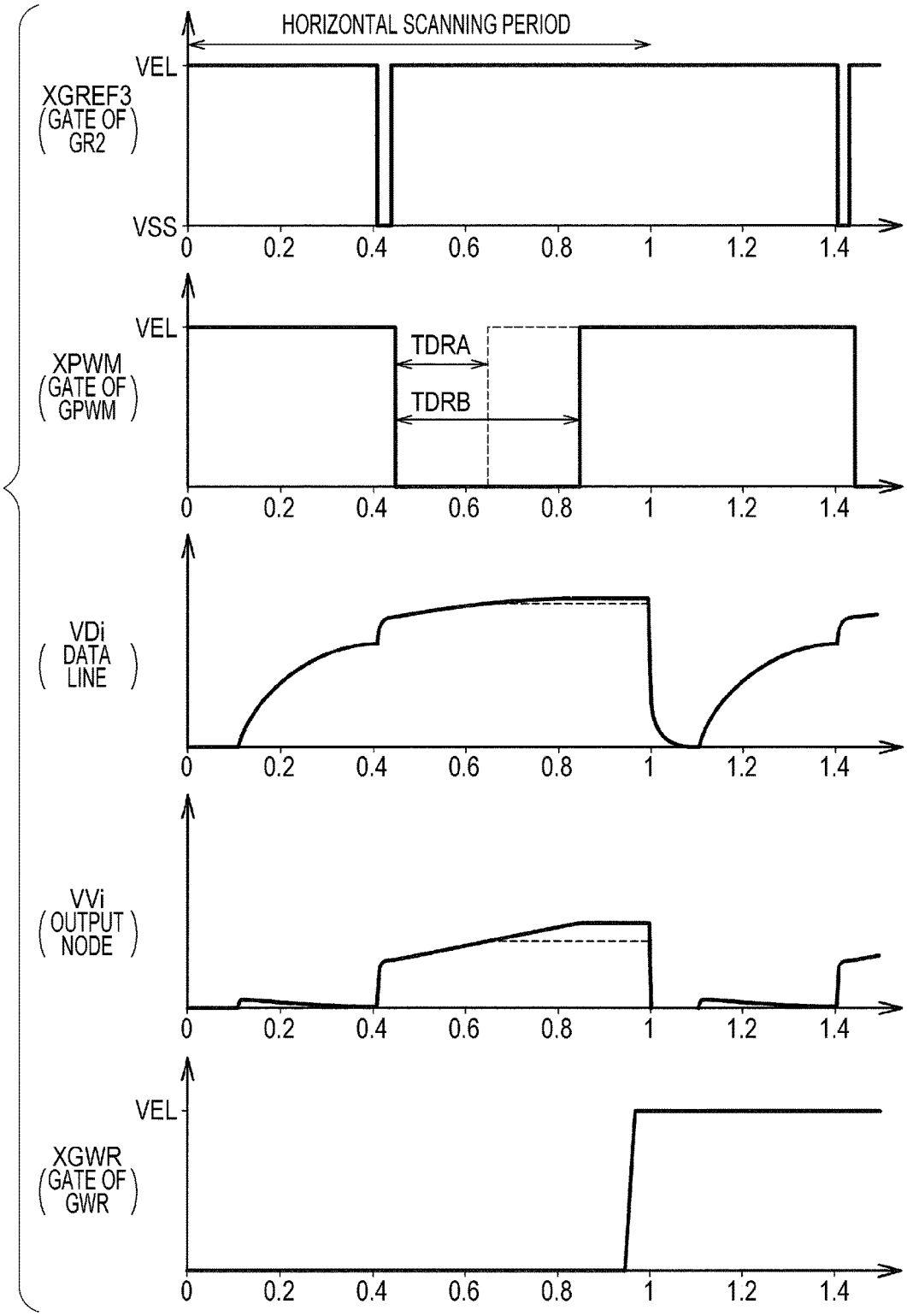
FIG. 7 is a timing chart describing operations of the current generation circuit and the pixel circuit.
Figure 8:
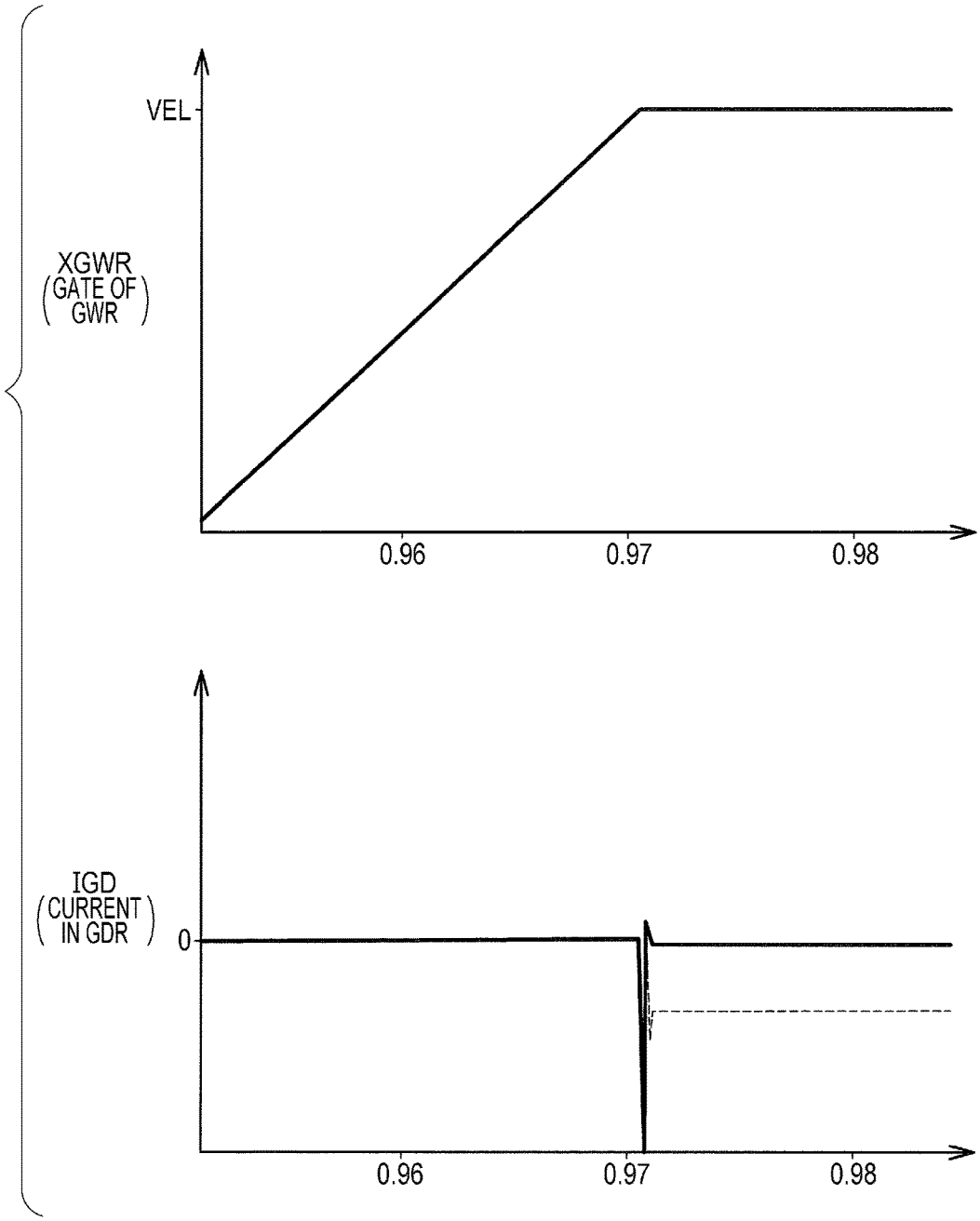
FIG. 8 is a timing chart describing operations of the current generation circuit and the pixel circuit.

The level of the variable voltage XPWM becomes high level from the low level after the driving period corresponding to the display data. FIG. 5, FIG. 7, and FIG. 8 illustrate waveforms in dotted lines in a case where the gradation (the brightness of the pixel) is the highest, and illustrate waveforms in solid lines in a case where the gradation is the lowest. The driving period TDRA in a case of highest gradation is shorter than the driving period TDRB in a case of the lowest gradation. The driving period in a case of a half-gradation is the middle thereof, and the driving period becomes short as the gradation increases.

Figure 6:
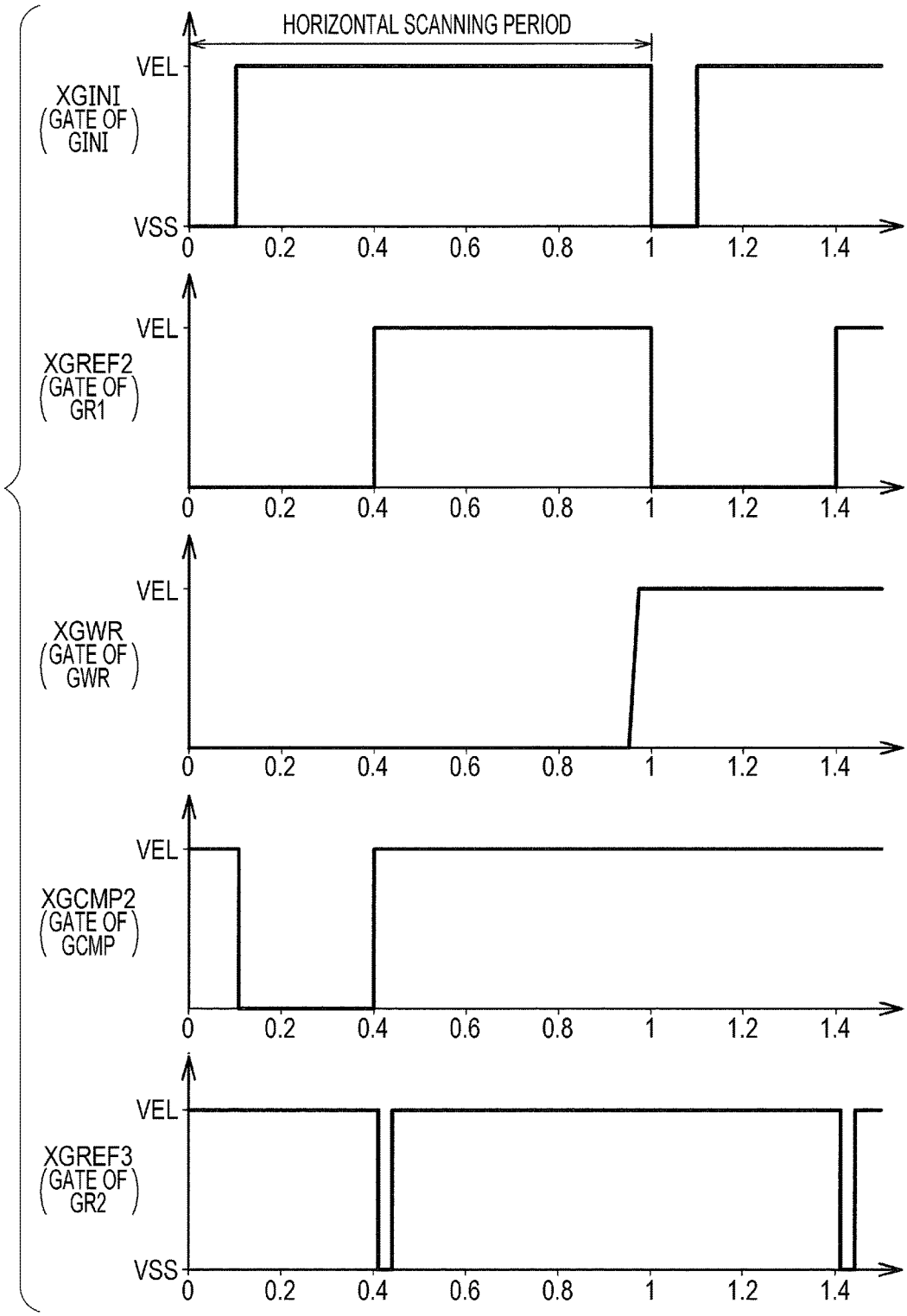
FIG. 6 is a timing chart describing operations of the current generation circuit and the pixel circuit.

In FIG. 6, the waveforms in the horizontal scanning period same as that in FIG. 5 are illustrated. The description will be made with reference to the voltages VDi and VVi in FIG. 7 as appropriate. As illustrated in FIG. 6, first, the level of the signal XGINI is low (VSS) and the transistor GENI is in an ON state. In this way, as illustrated in FIG. 7, the voltage VDi of the data line NDi is set to be the initial voltage.

As illustrated in FIG. 6, the level of a signal XGWR is low (½×VEL) and the transistor GWR is in an ON state, and thus, the gate of the transistor GDR and the data line NDi are connected to each other. After the transistor GENI is in an ON state, the level of the signal XGCMP2 becomes low (⅔×VEL), and then, the transistor GCMP is in an ON state. In this way, the gate and drain of the transistor GDR are connected to each other and the gate voltage (the voltage VDi of the data line NDi in FIG. 7) is close to the threshold voltage of the transistor GDR and thus, the voltage VDi is held in the capacitor CD. At this time, the level of the signal XGREF2 (⅔×VEL), and then, the transistor GR1 is in an ON state. In this way, as illustrated in FIG. 7, the voltage Wi of the output node NVi is fixed to the voltage VREF2.

As illustrated in FIG. 6, after the transistors GCMP and GR1 are in OFF state, the level of the signal XGREF3 low (VSS), and thus, the transistor GR2 is in an ON state. As illustrated in FIG. 7, the voltage VDi at the output node NVi increases from the voltage VREF2 to the voltage VREF3 (>VREF2), and the voltage VDi of the data line NDi (the gate voltage of the transistor GDR) due to the coupling by the capacitors CAi. In this way, the threshold voltage held in the capacitor CD is offset, and it is possible to cause the driving period TDRi (TDRA and TDRB) to start in a state in which the variation of the threshold voltage of the transistor GDR is compensated.

In FIG. 7, the waveforms during the horizontal scanning period same as that in FIG. 5 and FIG. 6 are illustrated. As illustrated in FIG. 7, the level of the signal XGREF3 becomes high from low, and after the transistor GR2 in an OFF state, the level of the variable voltage XPWM changes to low (close to ⅔×VEL, varies according to the temperature) from high. AS described in FIG. 5, the drive transistor KDR outputs the constant current Iai, and the voltage VVi of the output node NVi and the voltage VDi of the data line NDi linearly increase. When the driving periods TDRA and TDRB end, the level of the variable voltage XPWN become low and the voltages VVi and VDi stop increasing. The arrival voltage can be high when the driving period is long (the transistor GDR comes closer to an OFF state). The reason why the slope of the voltage VDi is larger than that of the voltage VVi is because the voltage is divided by the capacitors CAi and a parasitic capacitance CE of the data line NDi. The data line NDi is accompanied by the parasitic capacitance CE, however, the capacitor may hold dielectrics between the electrodes thereof. In addition, this power supply node to which the capacitor is connected may be the node of the high-potential side power supply voltage VEL or may be another power supply node such as the node of the power supply voltage VORST.

The level of the signal XGWR becomes high from low after the longest driving period (the driving period TDRB corresponding to the lowest gradation), and the transistor GWR is in an OFF state. As a result, the gate of the transistor GDR and the data line NDi are disconnected, and the gate voltage at this time (the voltage VDi of the data line NDi) is held in the capacitor CD. The transistor GWR is in an OFF state until the horizontal scanning line of the pixel circuit Pij is selected during the next vertical scanning period.

In FIG. 8, the drain current IGD in the transistor GDR in the vicinity of a point where the transistor GWR is in an OFF state is illustrated. Although illustration is omitted, the level of the signal XGEL becomes low when the transistor GWR is in an OFF state and the transistor GEL is in an ON state. Then, the transistor GDR outputs the drain current IGD corresponding to the gate voltage held in the capacitor CD to the organic EL element Dij so as to emit the light with brightness corresponding to the display data. The dotted line indicates the drain current when the gradation is maximum (the driving period is shortest) and the solid line indicates the drain current when the gradation is minimum (the driving period is longest).

The gate voltage of the transistor GDR held in the capacitor CD becomes lower than the threshold voltage. However, a slight drain current flows in this region, and thus, the light emission brightness (the gradation) of the organic EL element is controlled by controlling such slight current.

4. Temperature Compensation Method

Figure 9:
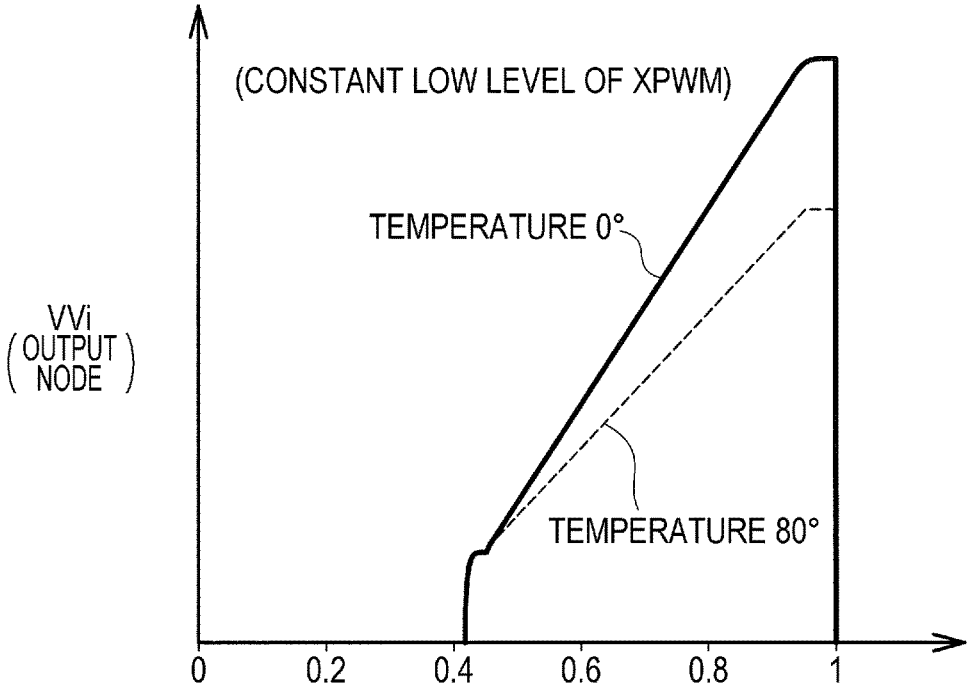
FIG. 9 is a diagram describing a temperature compensation of a constant current supplied by a drive transistor.
Figure 10:
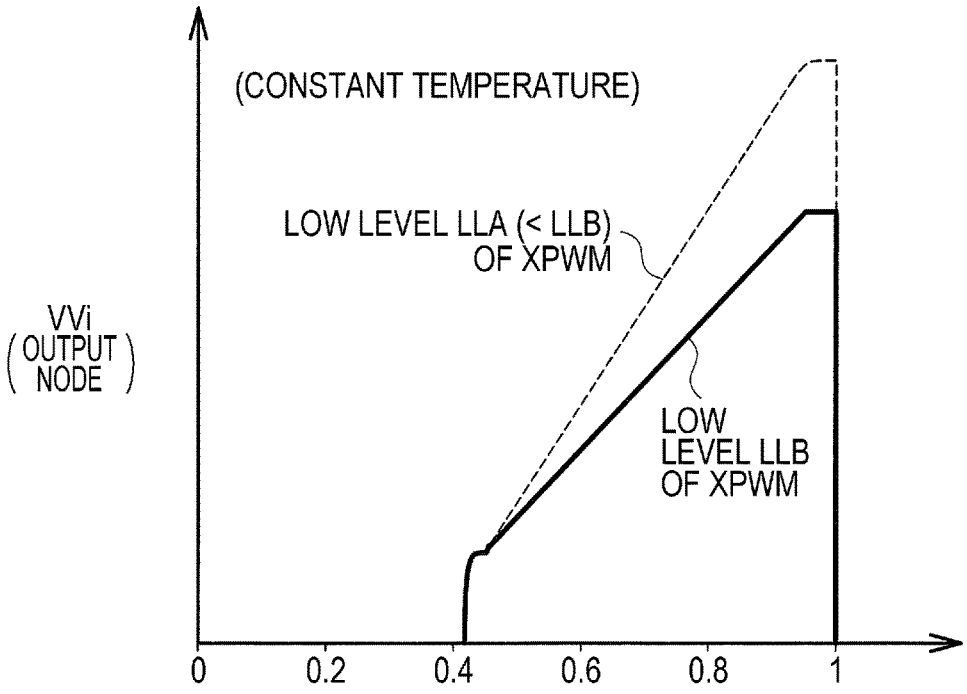
FIG. 10 is a diagram describing a temperature compensation of a constant current supplied by a drive transistor.

FIG. 9 and FIG. 10 are diagrams describing the temperature compensation of the constant current supplied by the drive transistor KDR. The horizontal axis represents the time, and represents the time with the horizontal scanning period as "one" unit similarly to that in FIG. 5 to FIG. 8.

FIG. 9 illustrates the voltage VVi at the output node NVi of the current generation circuit GCi in a case where the temperature is changed while the level of the variable voltage XPWM being constantly low (the voltage level during the driving period). The driving ability of the drive transistor KDR decreases and the constant current decreases as the temperature increases, and thus, the slope indicating the change of the voltage VVi becomes small.

FIG. 10 illustrates the voltage VVi at the output node NVi of the current generation circuit GCi in a case where the low level of the variable voltage XPWM is changed while the temperature being constant. FIG. 10 illustrates a case where the level of the variable voltage XPWM is a low level LLA and a case where the level of the variable voltage XPWM is low level LLB which is higher than the low level LLA. As the low level of the variable voltage XPWM becomes lower, the gate voltage of the drive transistor KDR decreases (the offset to the threshold voltage increases), and driving ability of the drive transistor KDR increases, and thus, the slope indicating the voltage VVi becomes large.

In the embodiment, as the temperature detected by the temperature sensor increases, the low level of the variable voltage XPWM is decreased. The temperature dependency of the constant current is cancelled, and thus, it is possible to obtain the constant current which is constant without depending on the temperature. The correspondence information between each temperature each of the low levels of the variable voltage XPWM may be measured at the time of manufacturing or the like and may be stored in a storage unit (not illustrated) included in the display device 100 (or may be written in a register of an external processing device of the display device 100). The voltage generation circuit 50 in FIG. 11 outputs the low level of the variable voltage XPWM to the current generation circuit GCi based on the correspondence information stored in the storage unit (or written in the register) and the result of detection of the temperature from the temperature sensor 60.

5. Detailed Configuration Example of the Display Device

FIG. 11 is a detailed configuration example of the display device 100 in the embodiment. The display device 100 in FIG. 11 includes the drive circuit 10, pixel array 20, a control circuit 30, an interface circuit 40, the voltage generation circuit 50, and the temperature sensor 60.

The interface circuit 40 performs communications between the display device 100 and the external processing device. For example, a clock signal and the display data are input to the control circuit 30 from the external processing device via the interface circuit 40.

The control circuit 30 controls each unit in the display device 100 based on the clock signal and the display data input via the interface circuit 40. For example, the control circuit. 30 performs the selection of the horizontal scanning line of the pixel array 20 or the control of the display timing such as the vertical synchronization, and performs the control of the current generation circuit Gdi (the drive circuit 10) or the pixel circuit Pij (the pixel array 20) according to the display timing.

The temperature sensor 60 measures the temperature of the display device 100. For example, the temperature sensor 60 performs A/D conversion on a difference between the voltage that depends on the temperature (for example, the forward direction voltage of a PN junction) and a voltage that does not depend on the temperature (for example, a band gap reference voltage), and outputs the temperature data (temperature information).

The voltage generation circuit 50 generates various voltages and outputs the voltages tea the drive circuit 10, For example, the voltage generation circuit 50 includes a voltage generation circuit (for example, a ladder resistance) that generates a plurality of voltages and a D/A conversion circuit (a voltage selection circuit) that selects any voltage from the plurality of voltages. The low level of the variable voltage XPWM is variably controlled by changing the voltage selected by the D/A conversion circuit based on the temperature data.

6. Modification Example

Figure 12:
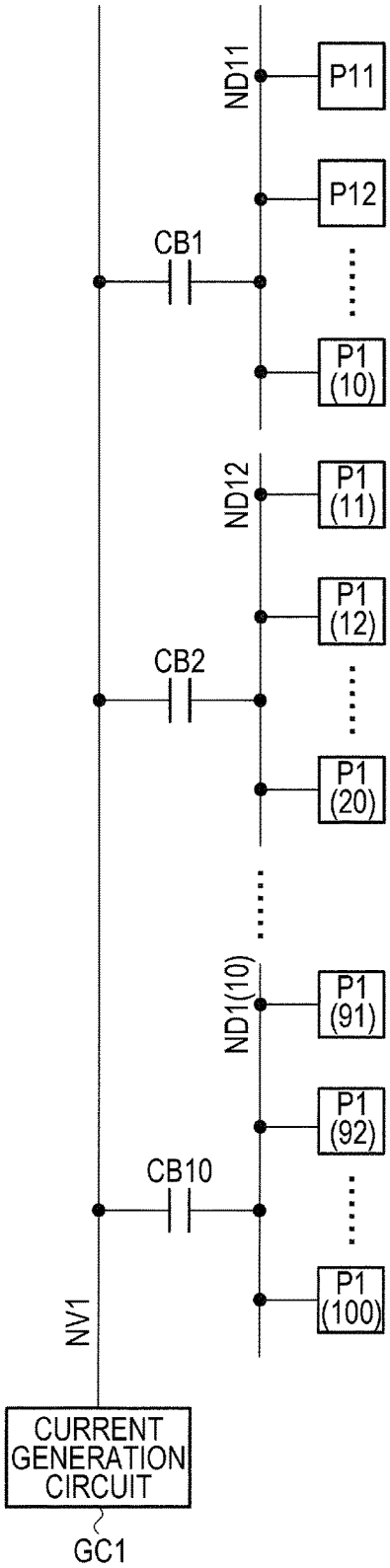
FIG. 12 is a modified configuration example of capacitors provided between output nodes of a voltage generation circuit and data lines.

FIG. 12 is a modified configuration example of capacitors provided between output nodes of a voltage generation circuit and data lines. In FIG. 12, a configuration example of the capacitors connected to the output nodes NV1 of the current generation circuit GC1 is illustrated. However, the capacitors connected to the output nodes NV2 to NVn are similar to the above.

In this modification configuration example, 10 pixel circuits are connected to the data lines ND (1) to ND1 (10), and the capacitors CB1 to CB10 are connected between the output nodes NV1 of the current generation circuit GC1 and the data lines ND (1) to ND1 (10). When the current generation circuit GC1 outputs the constant current during the driving period, the voltages at the data lines ND (1) to ND1 (10) increase via the capacitors CB1 to CB10. The data voltage written into the pixel circuit can be controlled by setting the driving period according to the display data. In FIG. 12, m=100 and the number of pixel circuits connected to each data line is 10. However, the number m is not limited to 100 and the number of pixel circuits connected to each data line is not limited to 10.

7. Electronic Apparatus

Figure 13:
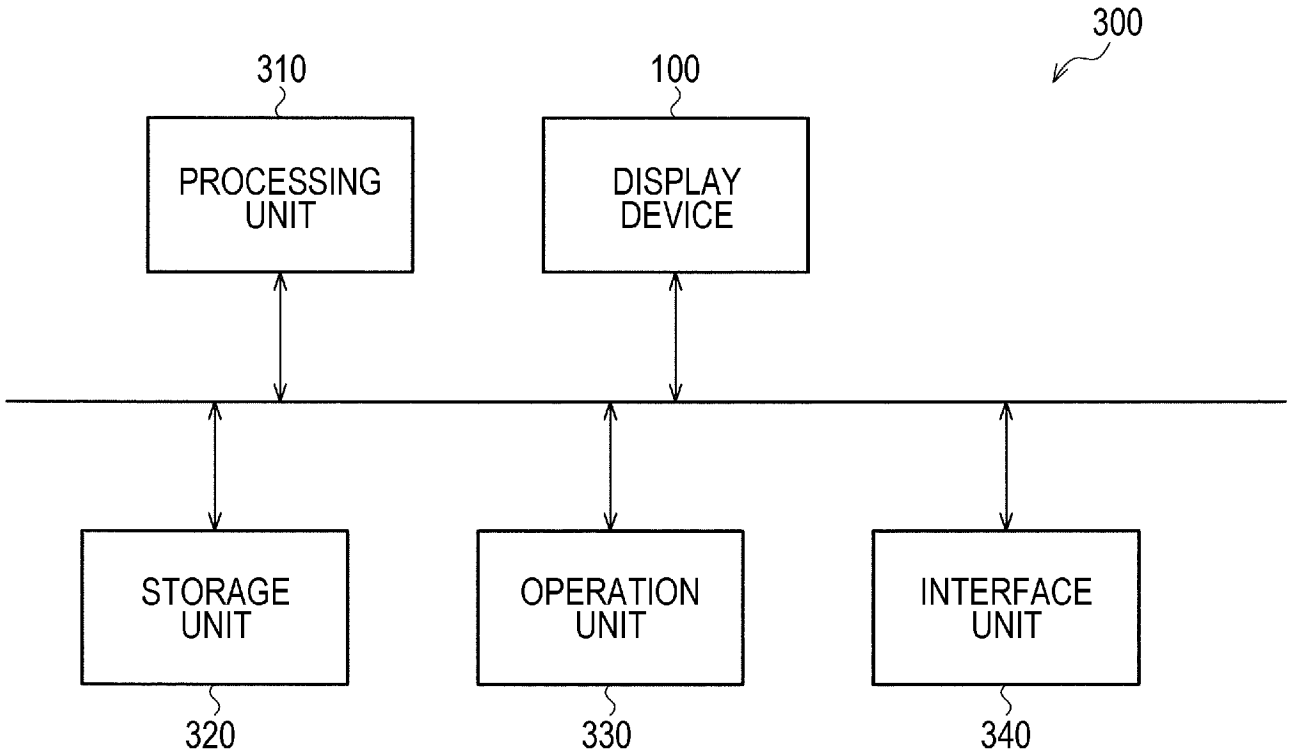
FIG. 13 is a configuration example of an electronic apparatus including the display device in the embodiment.

FIG. 13 is a configuration example of an electronic apparatus 300 including the display device 100 in the embodiment. Various electronic apparatuses on which the display device is mounted, such as head mounted display, mobile information terminal, an in-vehicle device (for example, a meter panel and a car navigation system), a mobile game terminal, an information processing device can be included in the specific example of the electronic apparatus 300.

The electronic apparatus 300 includes a processing unit 310 (for example, a processor such as a CPU, or a gate array), a storage unit 320 (for example, a memory, a hard disk, and the like), an operation unit 330 (an operation device), an interface unit 340 (an interface circuit or an interface device), and the display device 100 (display).

The operation unit 330 is a user interface that receives various operations from the user. For example, a button, a mouse, a keyboard, a touch panel mounted on the display unit 350 and the like are included in the interface. The interface unit 340 is a data interface that performs input and output of image data and the control data. For example, a wired communication interface such as USB or a wireless communication interface such as wireless LAN are included in the interface unit 340. The storage unit 320 stores the data input from the interface unit 340. Alternatively, the storage unit 320 functions as a working memory of the processing unit 310. The processing unit 310 performs data processing on the display data input from the interface unit 340 or stored in the storage unit 320, and transfers the processing result to the display device 100. The display device 100 displays the image on the pixel array based on the display data transferred from the processing unit 310.

The embodiment is described in detail as above, however, those skilled in the art can easily understand that many modifications can be made, which do not practically depart from the new items and effects of the invention. Therefore, all of those modification examples will be included in the scope of the invention. For example, in the description or in the drawings, the term that is used at least once together with another term having a broader meaning or the same meaning can be replaced by that another term in any places in the description or in the drawings. In addition, all the combinations of the embodiment and the modification examples will be included in the scope of the invention. In addition, the configurations and operations of the drive circuit, the pixel array, the display device, and the electronic apparatus are also not limited to those described in the embodiment, and various modifications can be embodied.

The entire disclosure of Japanese Patent Application No. 2016-127272, Jun. 28, 2016 is expressly incorporated by reference herein.

What is claimed is:

1. A display device comprising:

a pixel circuit;

a data line connected to the pixel circuit;

a capacitor with a first end and a second end, the first end being directly connected to the data line;

a wiring directly connected to the second end of the capacitor;

a drive circuit having an output node connected to the second end of the capacitor through the wiring, wherein:

the drive circuit outputs a constant current to the output node during a driving period, a length of which is set according to display data;

the drive circuit includes a current generation circuit for causing the constant current to flow through the output node;

the current generation circuit includes a drive transistor for causing the constant current to flow and a compensation circuit that compensates a variation of the threshold voltage of the drive transistor; and the compensation circuit includes a first transistor that is provided between a gate and a drain of the drive transistor and a first capacitor provided between the gate of the drive transistor and a node of a reference voltage.

2. A display device comprising: a pixel circuit;

a data line connected to the pixel circuit;

a capacitor with a first end and a second end, the first end being directly connected to the data line;

a wiring directly connected to the second end of the capacitor;

a drive circuit having an output node connected to the second end of the capacitor through the wiring, wherein:

the drive circuit outputs a constant current to the output node during a driving period, a length of which is set according to display data;

the drive circuit includes a current generation circuit for causing the constant current to flow through the output node;

the current generation circuit includes a drive transistor for causing the constant current to flow and a compensation circuit that compensates a variation of the threshold voltage of the drive transistor;

the current generation circuit includes a second capacitor that is provided between a gate of the drive transistor and a node of a variable voltage; and a gate voltage of the drive transistor set by the compensation circuit is variably controlled by the variable voltage.

3. The display device according to claim 1, wherein each of the current generation circuits includes an initial voltage setting circuit that sets an initial voltage at the gate of the drive transistor.

4. The display device according to claim 1, wherein the current generation circuit includes a second transistor that is provided between the drive transistor and an output node of the current generation circuit, and is in an ON state during the driving period.

5. The display device according to claim 4, wherein the period during which the second transistor is in the ON state is set according to the display data.

6. The display device according to claim 1, wherein the current generation circuit includes a first voltage setting circuit that sets a first voltage at the output node thereof during a compensation period of the pixel circuit.

7. The display device according to claim 1, wherein the current generation circuit includes a second voltage setting circuit that sets a second voltage at the output node thereof before the start of the driving period.

8. A display device comprising:

a pixel circuit;

a data line connected to the pixel circuit;

a capacitor with a first end and a second end, the first end being directly connected to the data line;

a wiring directly connected to the second end of the capacitor;

a drive circuit having an output node connected to the second end of the capacitor through the wiring, wherein:

the drive circuit outputs a constant current to the output node during a driving period, a length of which is set according to display data;

the drive circuit includes a current generation circuit for causing the constant current to flow through the output node;

the current generation circuit includes a drive transistor for causing the constant current to flow and a compensation circuit that compensates a variation of the threshold voltage of the drive transistor; and a gate voltage of the drive transistor during the driving period is variably controlled based on a result of detection of a temperature from a temperature sensor.

9. The display device according to claim 8, wherein a slope of a voltage change at the output node of the current generation circuit during the driving period is controlled based on the result of detection of the temperature from the temperature sensor.

10. The display device according to claim 1, wherein the pixel circuit is a pixel circuit configured for organic EL elements.

11. The display device according to claim 2, wherein each of the current generation circuits includes an initial voltage setting circuit that sets an initial voltage at the gate of the drive transistor.

12. The display device according to claim 8, wherein each of the current generation circuits includes an initial voltage setting circuit that sets an initial voltage at a gate of the drive transistor.

13. The display device according to claim 2, wherein the current generation circuit includes a second transistor that is provided between the drive transistor and an output node of the current generation circuit, and is in an ON state during the driving period.

14. The display device according to claim 8, wherein the current generation circuit includes a second transistor that is provided between the drive transistor and an output node of the current generation circuit, and is in an ON state during the driving period.

15. The display device according to claim 13, wherein the period during which the second transistor is in the ON state is set according to the display data.

16. The display device according to claim 14, wherein the period during which the second transistor is in the ON state is set according to the display data.

17. The display device according to claim 2, wherein the current generation circuit includes a first voltage setting circuit that sets a first voltage at the output node thereof during a compensation period of the pixel circuit.

18. The display device according to claim 8, wherein the current generation circuit includes a first voltage setting circuit that sets a first voltage at the output node thereof during a compensation period of the pixel circuit.

19. The display device according to claim 2, wherein the current generation circuit includes a second voltage setting circuit that sets a second voltage at the output node thereof before the start of the driving period.

20. The display device according to claim 8, wherein the current generation circuit includes a second voltage setting circuit that sets a second voltage at the output node thereof before the start of the driving period.

* * * * *